US012221780B2

(12) United States Patent
De Waal

(10) Patent No.: US 12,221,780 B2
(45) Date of Patent: Feb. 11, 2025

(54) SUBSTANCE DISPENSER, USE THEREOF, AND METHOD FOR MANUFACTURING

(71) Applicant: Toilet Tapes B.V., Nederweert (NL)

(72) Inventor: Oskar Anthoni De Waal, Nederweert (NL)

(73) Assignee: Toilet Tapes B.V., Nederweert (NL)

( * ) Notice: Subject to any disclaimer, the term of this patent is extended or adjusted under 35 U.S.C. 154(b) by 496 days.

(21) Appl. No.: 17/613,723

(22) PCT Filed: May 22, 2020

(86) PCT No.: PCT/NL2020/050330
§ 371 (c)(1),
(2) Date: Nov. 23, 2021

(87) PCT Pub. No.: WO2020/236003
PCT Pub. Date: Nov. 26, 2020

(65) Prior Publication Data

US 2022/0235539 A1 Jul. 28, 2022

(30) Foreign Application Priority Data

May 23, 2019 (NL) ..... 2023183

(51) Int. Cl.
*E03D 9/03* (2006.01)

(52) U.S. Cl.
CPC ..... *E03D 9/032* (2013.01)

(58) Field of Classification Search
CPC ..... E03D 9/032
(Continued)

(56) References Cited

U.S. PATENT DOCUMENTS

2006/0137081 A1* 6/2006 Ferrara ..... E03D 9/032 4/231
2009/0293916 A1* 12/2009 Wiedemann ..... E03D 9/032 264/319
2021/0025153 A1* 1/2021 Leoppold ..... B29C 51/002

FOREIGN PATENT DOCUMENTS

DE 8906140 11/1989
WO WO-0127398 4/2001
(Continued)

OTHER PUBLICATIONS

International Search Report of Written Opinion, International Application No. PCT/NL2020/050330, dated Sep. 9, 2020, 8 pages.

*Primary Examiner* — Huyen D Le
(74) *Attorney, Agent, or Firm* — Quarles & Brady LLP

(57) ABSTRACT

Substance dispenser (1) for temporarily placement on a flush bowl (100), comprising a flexible connecting part (21) including a layer of film material (20) defining a first surface, in particular a rear surface. The first surface is provided with a first adhesive (31) for temporary connecting said connecting part to a rim of the flush bowl. The substance dispenser further comprises a handle part (22), connected to the connecting part (21) at or near a first end region of said connecting part, for handling the substance dispenser (1) during placement on the flush bowl (100) and for handling the substance dispenser (1) during removal from the flush bowl (100). Further, the substance dispenser comprises a substance holder (50) holding a substance. In particular, the substance may comprise a cleaning agent, disinfectant, air freshener, and/or a descaling agent. The substance holder (50) is connected to the connecting part (21) at or near a second end region of said connecting part.

18 Claims, 3 Drawing Sheets

(58) Field of Classification Search
USPC ..... 4/223
See application file for complete search history.

(56) References Cited

FOREIGN PATENT DOCUMENTS

| | | |
|---|---|---|
| WO | WO-2006-058894 | 6/2006 |
| WO | WO-2015-072848 | 5/2015 |

* cited by examiner

SUBSTANCE DISPENSER, USE THEREOF, AND METHOD FOR MANUFACTURING

RELATED APPLICATIONS

This application is a 35 U.S.C. § 371 national phase application of PCT/NL2020/050330 (WO 2020/236003), filed on May 22, 2020, entitled "SUBSTANCE DISPENSER, USE THEREOF, AND METHOD FOR MANUFACTURING", which application claims the benefit of Netherlands Application No. 2023183, filed May 23, 2019, which is incorporated herein by reference in its entirety.

The invention relates to a substance dispenser for temporarily placement on a flush bowl.

Such substance dispenser are often used in the flush bowl of a flush toilet, and may alternatively be used in the flush bowl of a urinal, for instance to dispense a cleaning agent, disinfectant, air freshener, and/or a descaling agent when the water flows through the flush bowl, for instance upon flushing the toilet.

A known substance dispenser comprises a plastic holder with a hard tablet-shaped substance held therein, and it further comprises a deformable plastic bracket that can be clamped over a rim of a flush bowl of a flush toilet. The plastic holder and bracket of the substance dispenser are normally manufactured by means of injection molding and are made from a sturdy, resilient plastic. Owing to the resilient plastic the bracket can be bent outward when being arranged on the upper edge or rim of the flush bowl, after which it clamps fixedly to the upper edge.

A drawback of such known substance dispenser is that they are designed for an average shape of a flush bowl, wherein use is made of a certain shape of the outer side of the flush bowl and a certain shape of its upper edge as well as the inner side of the flush bowl. There are however numerous models of toilets with differently shaped flush bowls on the market, such that the bracket of the substance dispenser will not fit properly onto each flush bowl. This may become evident for instance when the bracket has to be bent too far outward to fit over the edge, when the bracket continually comes loose from the upper edge, or for instance when the holder with the substance tablet does not hang in the flow path of the flushing water.

Another drawback is that such known substance dispenser include large amounts of plastic, which, at least when the known substance dispenser is designed as a disposable, which is intended to be used for for instance about four weeks, may have a serious impact on the environment.

Further, for instance to counteract that the substance dries out, to counteract that fragrance to be released in the flush bowl may evaporate prematurely, and/or to counteract that perfumes or smells can contaminate other provisions stored in the same place as said dispenser, the substance dispenser is usually sold in a state in which each substance dispenser is stored in a sealed plastic bag, which may be formed as a flow pack foil, which causes that even more plastic is used.

It is an object of the invention to provide an alternative substance dispenser. In particular, it can be an object of the invention to provide a substance dispenser, wherein at least one of the disadvantages of a prior art substance dispenser is counteracted. More in particular, the invention may aim to provide a substance dispenser wherein at least one of the disadvantages mentioned above is counteracted. In embodiments, the invention aims at providing a substance dispenser, in particular a disposable substance dispenser, which may counteract the use of plastic material. Additionally or alternatively, it can be an aim of the invention may to facilitate that a substance dispenser may be applied to a toilet in a relatively easy manner, and/or that it may be removed relatively conveniently. Additionally or alternatively, it can be an aim of the invention to facilitate that a substance dispenser can be manufactured in a relatively simple manner.

Thereto, the invention provides for a substance dispenser according to the features of claim 1.

By providing the substance dispenser with a flexible connecting part including a layer of film material defining a first surface, in particular a rear surface, which is provided with a first adhesive for temporary connecting said connecting part to a rim of the flush bowl, it can be attached relatively easily, especially substantially independently of the exact shape or dimension of the flush bowl, in particular as the flexible connecting part, which may be considered to be limp, can form a connecting part which does have a certain tensile strength but a negligible bending strength, such that it can be draped over the edge of a flush bowl relatively conveniently, in particular as the weight of the substance holder and/or the substance held therein may pull it substantially tight.

As the first adhesive may be a relatively easily removable pressure sensitive adhesive, the substance dispenser may also be repositioned, for instance if it accidently is applied at a position where the water does not flow over it well enough when the toilet is flushed. Further, the adhesive may be such that it does not leave any marks on enamel of the flush bowl.

By arranging the substance dispenser such that it can be brought from a storage state into the use state, wherein, in said storage state of the substance dispenser, a cover substantially covers one or more portions of a surface which are at least partly open in the use state, it can be facilitated that the substance held in the substance holder may be closed off from the surroundings, in particular when said cover is removably attached, especially adhered, to the substance holder and/or to the substance held in said substance holder, preferably in a substantially airtight manner. This may omit the need of packaging the substance dispenser in an additional plastic bag, which may be formed as a flow pack foil or the like, as a result of which the substance dispenser can be relatively environmental friendly.

By forming the cover at least partly by a release liner onto which, in the storage state of the substance dispenser, at least the flexible connecting part is at least partly carried, an even more environmental friendly design may be facilitated as no separate cover is needed then. This may also ease the manufacturing process and/or may reduce costs.

The invention also relates to a flush bowl, in particular a flush bowl of a flush toilet, provided with a substance dispenser.

Further, the invention relates to a method for manufacturing a substance dispenser.

Advantageous embodiments according to the invention are described in the appended claims.

By way of non-limiting examples only, embodiments of the present invention will now be described with reference to the accompanying figures in which.

It is noted that the figures schematically show merely preferred embodiments according to the invention. In the figures, the same or similar reference signs or numbers refer to equal or corresponding parts.

Figure 1:
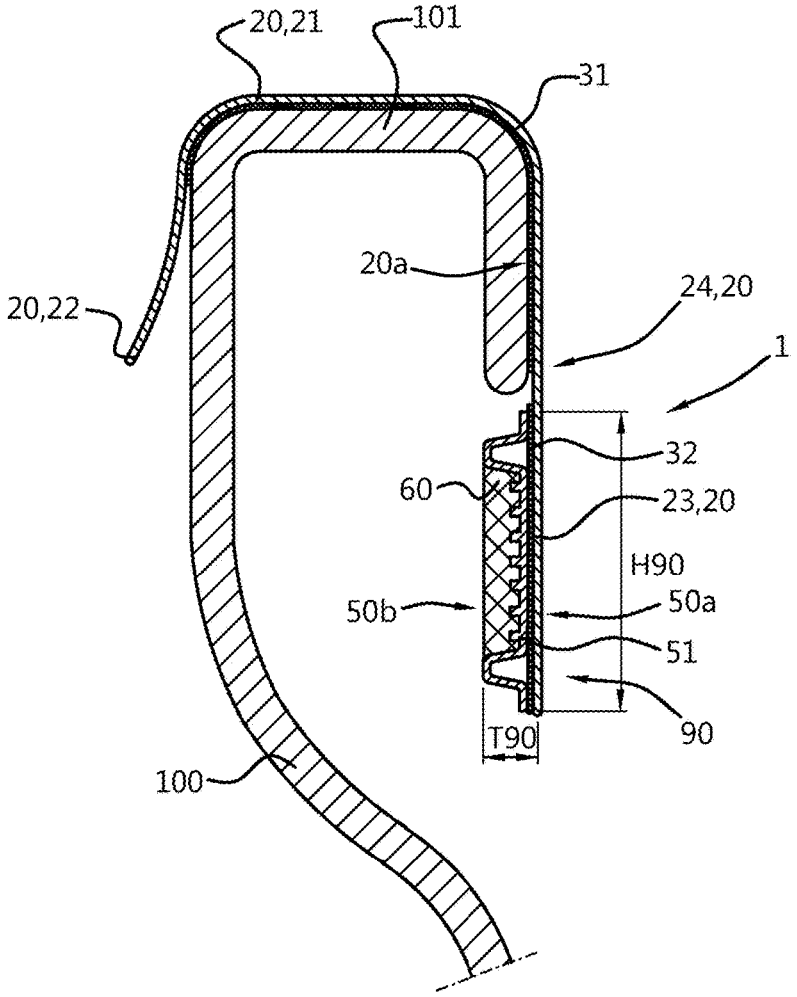
FIG. 1 shows a schematic cross-sectional view of a partly cut-away flush bowl provided with an embodiment of a substance dispenser according to an aspect of the invention.

FIG. 1 shows a schematic cross-sectional view of a partly cut-away flush bowl 100 provided an embodiment of a substance dispenser 1 in a use state thereof in which it is temporarily attached to a flush bowl 100, in particular by adhering it to rim 101 of said flush bowl 100. The flush bowl 100, or so-called flush basin or pan 100, can be the flush bowl of a flush toilet 100, for instance a flush toilet 100 designed for sitting and or a flush toilet for squatting, i.e. a so-called squat toilet.

It is noted that the substance dispenser 1 is arranged and/or intended for temporarily placement on the flush bowl 100. The substance dispenser 1 comprises a flexible connecting part 21 including a layer of film material 20. Preferably said flexible connecting part 21 is substantially formed from said film material, especially relatively thin film material, preferably plastic film material. The flexible connecting part 21 defines a first surface 20*a* which is provided with a first adhesive 31 for temporary connecting said connecting part to a rim 101 of the flush bowl 100. In particular, the first adhesive 31 may be arranged such as to allow the flexible connecting part 21 to be removed from the flush bowl 100 in a manner substantially not leaving behind adhesive on said bowl.

Advantageously, said first surface 20*a* is formed by a rear surface 20*a* of the layer of film material 20.

Said first adhesive 31 can preferably be a pressure sensitive adhesive 31, such as for instance is known from removably attachable stickers. It is appreciated that the first adhesive 31 can preferably be a removable adhesive, which can be easily removed from the flush bowl 100, in particular when said flush bowl is made from porcelain, e.g. enameled or glazed porcelain, or another ceramic material, and/or metal, e.g. stainless steel, and/or plastic material. The adhesive 31 may thus provide for a non-permanent sticking zone for suspending the substance dispenser 1 on, at or in a toilet.

Figure 2:
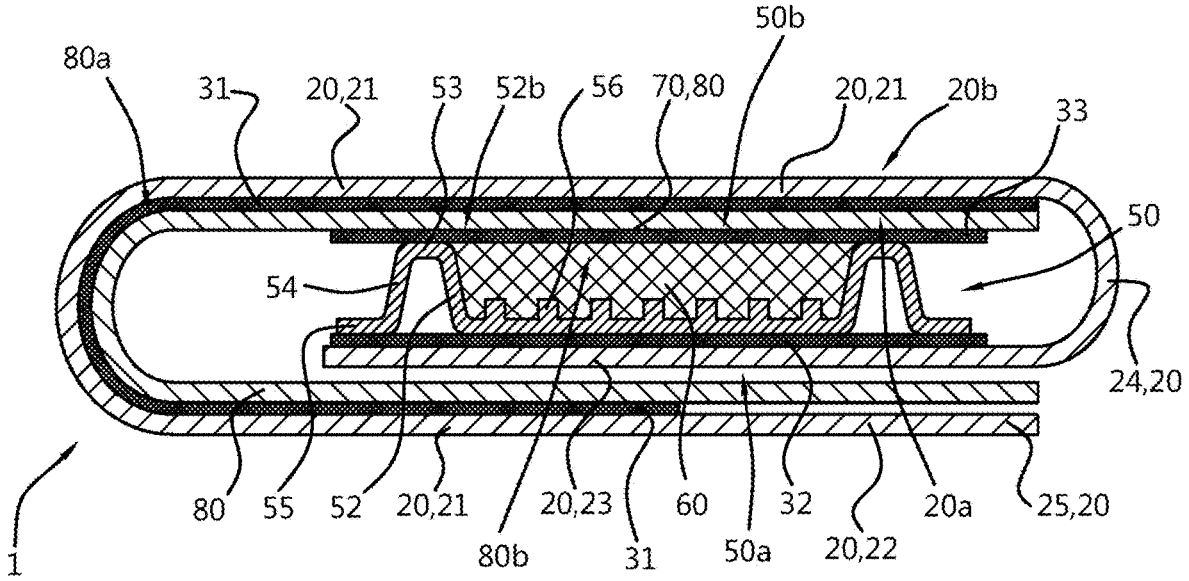
FIG. 2 shows a schematic cross-sectional view of the substance dispenser of FIG. 1 in a storage state thereof.

As the flexible connecting part 21 is sticky, like a sticker, it may, in a storage state of the substance dispenser 1, be substantially carried on a release liner 80, as for instance is the case in FIG. 2. The release liner 80 may for instance be a paper or plastic-based film sheet which may be coated with a release agent, which may provide a release effect against the first adhesive 31.

The substance dispenser 1 further comprises a handle part 22 connected to the connecting part 21 at or near a first end region 21*a* of said connecting part 21. The handle part 22 is arranged and/or intended for handling the substance dispenser 1 during placement on the flush bowl 100 and for handling the substance dispenser 1 during its removal from the flush bowl 100.

Advantageously, the layer of film material 20 defining the connecting part 21 may also define said handle part 22. In particular, the connecting part 21 and the handle part 22 may be formed from the same sheet of film material.

Additionally or alternatively, the handle part 22 can preferably be substantially kept free of adhesive, or, in case it is provided with adhesive, for instance when the first adhesive 31 would extend from the connecting part 21 over handle part 22, the adhesive may be covered, for example by a piece of sheet material attached to the adhesive provided. In the here shown embodiment, at least a portion of the handle part 22 is kept free of said first adhesive 31, as for instance can be seen relatively well in FIG. 2, thereby providing a non-sticking peel-off zone 22*a*, preferably located at a distal end of the substance dispenser 1, for allowing the handle part 22 to be grabbed in a relatively convenient manner and/or to be peeled off from the release liner 80, as is indicated by arrow A21 in FIG. 3.

Although the handle part 22 and the connecting part 21 can preferably be integrally formed, in particular from a single sheet of film material, the handle part 22 may in alternative embodiments be formed separately and may then be attached to the connecting part 21.

Further, the substance dispenser 1 comprises a substance holder 50 holding a substance 60. Said substance may for example comprise a cleaning agent and/or a disinfectant, such as an antimicrobial agent. Additionally or alternatively, the substance 60 may for example comprise an air freshener or so-called deodorizer which may be arranged to emit a fragrance or so-called odorant or aroma compound. Additionally or alternatively, the substance 60 may comprise a descaling agent, which may be arranged and/or intended for counteracting and/or removing limescale, and which for instance may comprise one or more acidic compounds.

The substance holder 50 is connected to the connecting part 21 at or near a second end region 21*b* of said connecting part 21. Thereto, the layer of film material 20 included in the flexible connecting part 21 may for instance also define an attachment zone 23 which is attached to the substance holder 50.

In embodiments, the substance dispenser 1 may be arranged such that a user can visually inspect whether there is still substance 60 available in the substance holder 50 when provided in the flush bowl 100 during use. Thereto, the attachment zone 23 may be at least transparent, especially such as to form one or multiple windows 26. Alternatively, or additionally, one or multiple windows 26 may be formed as openings, which in particular may be cut-out of the film material 20 defining the attachment zone 23. Additionally or alternatively, the substance holder 50 may be transparent at least partly, in particular it may be at least partly transparent at a bottom side 51*a* of the substance holder 50, for instance by making its bottom 51 at least partly transparent.

Preferably, the attachment zone 23 defined by the layer of film material 20 can be provided with a second adhesive 32, preferably a waterproof adhesive, for attaching said attachment zone 23 to the substance holder 50, in particular in a substantially permanent manner. Contrary to the first adhesive 31 which may be arranged for removable applications, the second adhesive 32 may thus be arranged for permanent applications.

As is the case in the exemplary embodiments shown in the Figures, see in particular FIG. 1, the second adhesive 32 can preferably be provided at the first surface 20*a* of the layer of film material 20. This may be advantageous, for instance as the attachment zone 23 and the connecting part 21 can then be formed relatively easily from a single sheet of film material, which for instance until the moment the attachment zone 23 is to be adhered to the substance holder 50, may be provided on a release liner 80 which carries both the attachment zone 23 and the connecting part 21. It will be appreciated that portion of the release liner 80 carrying the attachment zone 23 up to that moment may be removed afterwards, and that therefore the release liner 80 may be divided in two or more parts, e.g. by means of cutting.

Advantageously, a first surface 50*a* of the substance holder 50, which for instance may be formed by the bottom 51 of said holder 50 and which during use of said holder 50 may for instance form a front face 50*a*, as can be seen in FIG. 1, may be substantially closed off, in particular closed off substantially hermetical or air-tight.

For example, the substance holder 50 itself, in particular a bottom portion 51 thereof, may close off the substance holder 50 at said first surface 50*a*. Alternatively or additionally, the layer of film material 20, in particular an attachment zone 23 formed by said layer 20, may close off said first surface 50*a* of the substance holder 50. Additionally or alternatively, the layer of film material 20 can cover at least 80%, especially at least 90%, of said first surface 50*a* of the substance holder 50, and preferably said layer of film material 20 may cover said first surface 50*a* of the substance holder 50 substantially completely.

It will be appreciated that, at least in a use state of the substance dispenser 1, the holder 50 may allow water to flush away at least a portion of the substance 60. Thereto, at least in a use state of the substance dispenser 1, one or more portions of a second surface 50*b* of the substance holder 50, in particular a face side 50*b* located substantially opposite to the first surface 50*a* of the holder 50, such as for example a rear face 50*b*, can be at least partly open such as to allow flushing water to contact the substance 60 held by the substance holder 50.

Advantageously, the substance dispenser 1 may be provided with a cover 70 which, in a storage state of the dispenser 1, may substantially cover said one or more portions of the second surface 50*b* which are at least partly open in the use state, and preferably wherein said cover 70 then may substantially cover said entire second surface 50*b* of the substance holder 50 in the storage state of the substance dispenser 1.

Then, for instance especially when the substance holder 50 and the substance 60 held therein together form a relatively flat structure 90, the substance may be enclosed relatively well in such storage state of the dispenser 1. It is noted that, in particular, such relatively flat structure 90 may have a height 1190 and a width W90 which exceed its largest thickness T90, more in particular said thickness T90 being at most ½ of the height 1190 and/or the width W90, yet more in particular at most ⅓ of the height 1190 and/or the width W90, or even smaller.

Enclosing the substance 60, partially or completely, may have different advantages. For example, it may counteract that the substance 60 dries out.

It will be appreciated that the substance 60 provided in the holder 50 may preferably be enclosed substantially entirely, in particular in a substantially air-tight manner. Thereto, the holder 50, which may be formed as a cup or tray or alternatively shaped container 50 or so-called reservoir 50, may be arranged to close off the substance at its remaining sides, which are not yet covered by the cover 70 and/or the attachment zone 23 and/or portions 51 of the substance holder 50 located at said first surface 50*a*. For instance thereto, the substance holder 50 may comprise one or more sidewalls 52.

Preferably, the substance dispenser 1 may be of such a design that the cover 70 and the substance holder 50 together enclose the substance 60 in the storage state of said dispenser 1.

It is noted that the cover 70 can be removably attached, especially adhered, preferably by means of third adhesive 33, to the substance holder 50, in particular to the second surface 50*b* of the substance holder 50, preferably in a substantially airtight manner and preferably in a releasable manner. Additionally or alternatively, the cover may be attached, preferably adhered, to the substance 60 held in said substance holder 50, preferably in a substantially airtight manner and preferably in a releasable manner. Like the first adhesive 31, said third adhesive 33 may be arranged for removable applications, and may, alternatively or additionally may be a pressure sensitive adhesive 33.

Advantageously, the cover 70 can be formed at least partly, and preferably entirely, by a release liner 80 onto which, in the storage state of the substance dispenser 1, at least the flexible connecting part 21 is at least partly carried. In this manner, a relatively simple, in particular relatively economical, construction can be formed. For example, the substance dispenser 1 may be substantially formed out of for instance only four parts, i.e. the film material 20, the substance holder 50, the substance 60, and the release liner 80 for supporting one or more sticky portions of said film material.

Figure 3:
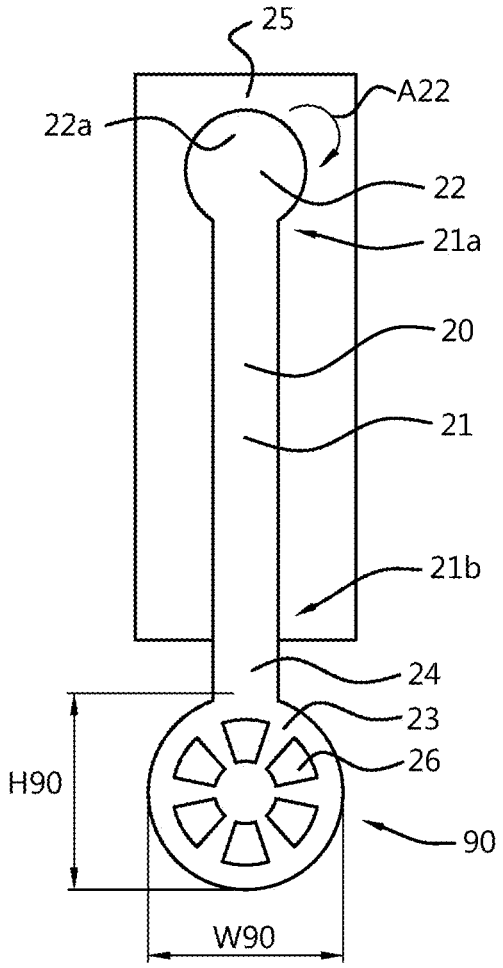
FIG. 3 shows a schematic top view of the substance dispenser of FIGS. 1 and 3.
Figure 4:
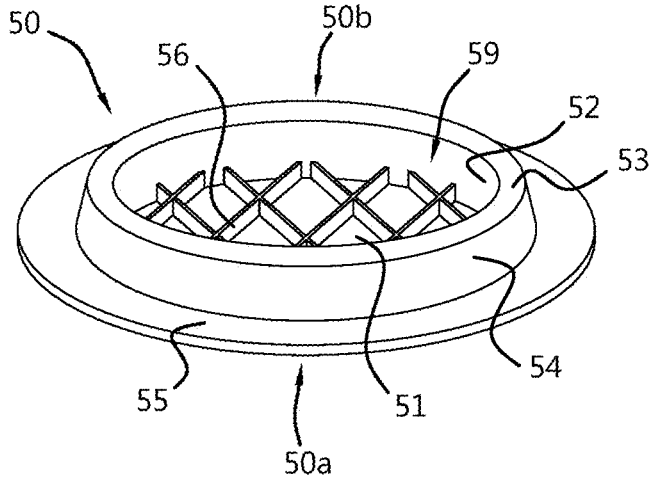
FIGS. 4-6 show three embodiments of a substance holder for a substance dispenser according to aspects of the present invention.

In embodiments, the release liner 80 may extend beyond the connecting part 21 and beyond the handle part 22, such as can be understood from FIG. 3. In the there shown embodiment, in the storage state of the dispenser 1, the release liner 80 extends also below an excess portion 25 of the film material 20 cut loose from the connecting part 21 and the handle part 22. For example, the release liner 80 may then be broad enough to cover the second surface 50*b* of the substance holder 50, as it may then for example be wider than the connecting part 21. The excess portion 25 of film material may be printed, and may for instance comprise information, which may include instructions and/or warnings or the like. Additionally or alternatively, other parts of the substance dispenser, in particular parts formed by the film material 20 may be provided with prints or the like, for instance in order to provide for an aesthetically appealing appearance. Additionally or alternatively, the layer of film material 20, in particular a printed second surface 20*b* of the said layer located opposite to its first surface 20*a*, may be covered at least partly by a finish or varnish layer or other cover layer, such as a silicon-containing finish layer, which may protect the printing, for instance against uric acid and/or cleaning agents, such as cleaning agents from the substance 60 and/or other cleaning agents used by a user to clean the flush bowl 100.

It will be appreciated that the release liner 80 can define a first surface 80*a* onto which the at least part of the flexible connecting part 21 is carried. In particular, a portion of the first surface 20*a* of the layer of film material 20 defining said flexible connecting part 21 may be carried on said first surface 80*a* of the release liner 80, and the substance holder and/or the substance held therein can then thus be removably adhered to a second surface 80*b* of said release liner 80 opposite to its first surface 80*a*.

Further, the layer of film material 20 may further define an intermediate part 24. Said intermediate part 24 can interconnect the attachment zone 23 and the flexible connecting part 21, which, in the storage state of the substance dispenser 1, can be bent, in particular such as to allow that the attachment zone 23 can, in said storage state, extend substantially offset from an/or substantially parallel with the connecting part 21, preferably in a manner in which said attachment zone 23 and said connecting part 21 overlap at least partly, as can be seen in FIG. 2. This may facilitate that the substance dispenser 1 can be stored relatively compactly, in particular in a relatively small container, such as cardboard-based box.

In embodiments, one or more parts of the substance dispenser 1 may be at least partly be provided with a coating. Said coating may for example be a water repellent and/or dirt repellent coating, and may for example comprise silicone coating material and/or other suitable materials.

Advantageously, at least one or more parts or portions of the substance dispenser 1, in particular parts or portions which during use of the substance dispenser 1 may hang at least partly inside a flush bowl of a flush toilet 100, may be provided with the coating, especially such as to counteract that said one or more parts or portions may be unintentionally soiled with feces or other dirt.

In particular, one or more portions of one or more parts or zones of the layer of film material 20, such as for example the flexible connecting part 21 and/or the intermediate part 24 and/or the attachment zone 23, may at least partly be provided with the coating, in particular at the second surface 20*b* thereof, which preferably is a printed surface. Although not necessarily, substantially the entire second surface 20*b* of the layer of film material 20 may be coated, for example to ease the production of the substance dispenser 1.

It is noted that the coating, which may form a substantially transparent coating layer and/or which may be used to cover and/or protect printing provided on the layer of film material 20, may be a UV-curable coating, which for instance may facilitate that it can cure relatively speedily.

Although the coating may most advantageously be used on the layer of film material 20, additionally or alternatively, the coating may be provided on the substance holder 50, for example on its outwardly facing side of the substantially wall-shaped support element 54 and/or on the side of its second flange 55 facing away from the attachment zone 23 of the layer of film material 20 and/or on the outwardly facing side of the first flange 53 of said substance holder 50.

In advantageous embodiments, said coating may be provided with a fragrance compound or perfume compound or aroma compound, which may be for releasing a predetermined scent or perfume, in particular during use of the substance dispenser 1, more in particular in a flush bowl of a flush toilet 100.

It has been surprisingly found that such a scented coating may in an original and inventive manner increase the life time of the substance dispenser 1, for instance with up to a few additional days, as the substance dispenser 1 may keep emitting odor to a certain desirable extent, even if most of, or even substantially all of the substance 60, which preferably comprises an air freshener or deodorizer, initially held in the substance holder 50 may already have been washed away out of said substance holder 50. Further, it will be appreciated that the coating and/or its fragrance compound or the like, if any, and/or any one or more of other parts or components of the substance dispenser 1, for instance all of them, may preferably be substantially non-toxic.

In embodiments, the substance holder 50, which holds the substance 60, can include one or more chambers 59 for holding the substance 60. In the embodiments of FIGS. 1, 2, 4 and 5, the holder 50 defines for instance one chamber 59. However, in alternative embodiments, the holder may comprise multiple chambers. Said one or more chambers 59 may be at least defined by a bottom 51 and one or more sidewalls 52.

A surface 51*a* of the bottom 51 facing away from the substance 60 held by said holder 50 can then be adhered to an attachment zone 23 defined by the layer of film material 20. Additionally or alternatively, the sidewall of the holder 50 may comprise a first flange 53, which may be provided at an upper end of the sidewall 52 and which may extend substantially sidewardly, in particular in a substantially outward direction, especially in a direction substantially transverse to an upward direction in which the side wall 52 extends.

In the storage state of the substance dispenser 1, said first flange 53 can be releasably attached, for instance adhered, to a cover 70, in particular a cover 70 formed by the release liner 80, more in particular to the second surface 80*b* thereof, preferably in a substantially airtight manner.

It will be appreciated that the release liner 80, or another cover 70, may alternatively be adhered to a wall 52 not having such flange 53, in particular in case said wall 52 is relatively thick and can as such itself define a relatively large top face 52*b*.

As for instance is the case in the embodiment of FIGS. 1 and 2, the sidewall 52 of the substance holder 50 can comprise a support element 54, in particular a substantially wall-shaped support element 54, which may extend from the first flange 53 in a substantially downward direction. Additionally or alternatively, the holder 50 may comprise a second flange 55 which can be provided at a lower end of the sidewall 52. In particular, said second flange 55, of so-called bottom flange 55, may be located at a lower end of the support element 54 of said side wall 52 and may extend substantially in a sideward direction, in particular in a substantially outward direction, especially substantially in line with the bottom 51 of the substance holder 50 or at a level below the bottom 51 of said holder 50, in particular such that the attachment zone 23 of the layer of film material 20 could be applied to said second flange 55 relatively well and/or relatively neatly.

In advantageous embodiments, the substance holder 50, which may be formed of a plastic, in particular a thermoplastic or so-called thermosoftening plastic, can be molded, preferably thermoformed. In particular, this may be done in a manner in which the surface 51*a* of the bottom 51 which during use of the dispenser 1 is facing away from the substance 60 held by the substance holder 50 is not in contact with a mold part. As a result, it can be counteracted that said surface 51*a*, which can be formed by a so-called bottom side 51*a* of the bottom 51 of the holder 50, is in contact with a mold surface provided with release agent during molding of said substance holder 50. It can then thus be counteracted relatively easily that the bottom surface 51*a* of the substance holder 50 may be contaminated by such release agent. Therefore, it may be counteracted that the attachments zone 23 will accidently not be properly adhered to the holder 50, and it may thus be counteracted that the holder 50 may accidently come loose from the layer of film material 20, which could be problematic, for instance as it could cause a blockage in a drainage pipe connected to the flush bowl 100.

Figure 5:
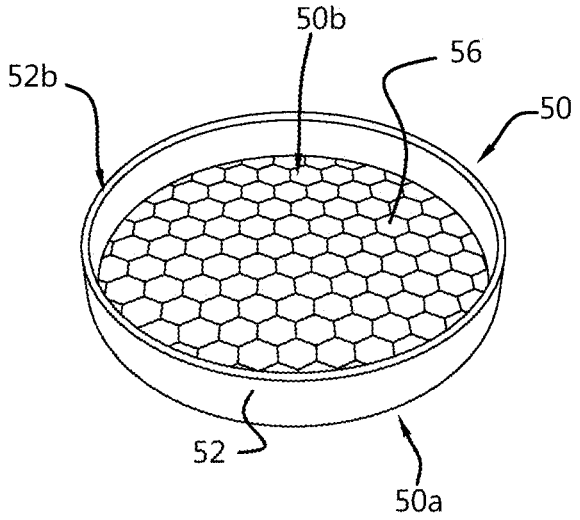
Figure 6:
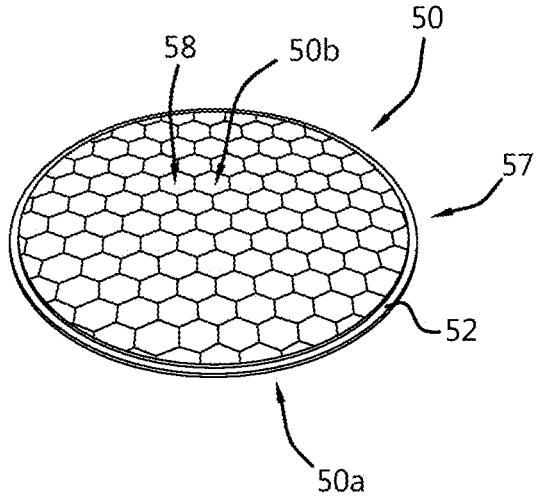

In preferred embodiments, a surface 51*b* of the substance holder 50, in particular a surface 51*b* of a bottom 51 of said substance holder 50 facing towards and/or in contact with the substance 60, can be provided with a relief structure 56. Said relief structure 50 may for instance be a substantially raster-shaped relief 56, for instance defining a honeycomb structure such as shown in the embodiments of FIGS. 5 and 6. However, other relief shapes are also possible. It is noted that the relief may facilitate that the substance 60, which may preferably be a pliable substance 60 and/or in the form of a paste 60 which may stick or adhere to the substance holder 50, may stick or adhere relatively well to said holder 50, thereby counteracting that a lump of substance 60 may come loose accidently as result of flush water.

It is noted that such pliable substance 60, which does not form a tablet or block loosely provided in a holder, but which may more or less form a paste-like substance sticking to the walls 51, 52 of the holder 50, may by poured into said holder as a warm emulsion, and which may stay viscous to some extent after it has cooled down.

In particular, said relief structure 56 may have a height less than the height of a sidewall 52 of the holder 50. Additionally or alternatively, said relief structure 56 can have a height of at most 10 mm, preferably at most 5 mm, for instance at most 3 mm or at most 2 mm, such as a height of between 0.5 mm and 2 mm. The side wall 52, which may also be relatively low, as the structure 90 formed by the substance holder 50 and the substance 60 held therein may preferably be relatively flat, may then for instance have a height of at most about 2 cm, preferably at most 1.5 cm, such as about 1 cm.

However, in alternative embodiments, the substance holder 50 can be substantially formed as a plate 57, in particular as a disc 57, such as for instance is the case in the exemplary embodiment shown in FIG. 6. The plate 57 may be provided with side wall 52, but this is not necessary for every embodiment.

It is noted that the relief structure 56, in particular in cases in which the substance holder 50 is formed as plate or disc 57, may form multiple cells 58 in which substance 60 can be held. When the cells 58 are covered by a cover 70, preferably formed by the release liner 80, in particular it rear surface 80*b*, the substance 60 can then be substantially closed off, for instance counteracting that it dries out, even if the entire substance dispenser 1 is not held in an airtight container, such as an airtight plastic bag, such as a flow pack foil, or other airtight envelope. However, the cover thus not necessarily needs to close off the cells 58 in the storage state of the substance dispenser 1, and may for instance only cover a top side of the substance, for instance in case the substance 60 is also applied on the top side of the relief structure 56, in stead of substantially only within said cells 58.

In this context, it is noted that in case the substance 60 is not completely enclosed in the storage state of the substance dispenser 1, the cover 70 may still be highly advantageous, as it, for instance together with a bottom 51 of the holder 50 and/or the attachment zone 23 of the layer of the film material 20 may screen off at least substantial portions of the substance 60 held by the substance holder 50.

In embodiments, the substance holder 50 may for example include, and preferably may be substantially formed as, a mesh, a sponge and/or a textile, such as a woven textile or a non-woven textile. It will be appreciated that, at least in such embodiments, the substance holder 50 does thus not need to form a cup or other container, and may thus be free of sidewalls. A first surface, e.g. a bottom surface, of such mesh, sponge or textile structure may be covered by the attachment zone 23 defined by the layer of film material 20 adhered to said structure, whereas an opposite surface, e.g. a top surface, may be covered by a cover 70, in particular a cover formed the release liner 80.

In embodiments, the attachment zone 23 may laterally extend beyond the lateral side edges of such mesh, sponge or textile, such that said attachment zone 23, as it can be formed from flexible film material and/or as the mesh, sponge or textile may be at least partly compressible, can be adhered to the bottom side 80*b* of the release liner 80. In order to facilitate that the holder can be removed from the release liner 80 in order to place the dispenser 1 in the flush bowl 100, the release liner 80 may be arranged such that the attachment zone 23 can be removed from it, e.g. by providing its 80*b* with a release agent. Alternatively, extending portions of the attachment zone 23 may be removably attached to a central portion of the attachment zone 23 substantially permanently adhered to the sponge, mesh or textile. However, other alternatives are possible. For example, the extending portions of the attachment zone 23 may be adhered to the bottom side 80*b* of the release liner 80 by a third adhesive 33 which may be relatively easily removable compared to the second adhesive 32 used to glue the central portion of the attachment zone 23 to said holder 50 including or formed as a mesh, sponge and/or textile.

Further, it is noted that such mesh, sponge or textile, which may form a relatively flat substance holder 50 or structure, and which may preferably be at most 3 mm thick, such as for instance about 1 mm, may be provided with the substance 60 by means of for instance impregnating, printing, or any other suitable technique.

Contrary to a holder which is substantially formed as a cup and which may be suitable to contain enough substance 60 to be used for instance for one or multiple weeks, a relatively flat substance holder 50, for instance including a plate or disc 57 and/or a mesh, sponge or textile structure or the like, may be intended to be used only for a relatively brief time period, such as a single day or a single weekend only, and may for instance contain only 1 gram of substance or even less. Such substance dispenser 1 may for instance be used in a hotel room, whereas a substance dispenser 1 which may comprise more substance 60 may for instance be intended for home use.

As the substance 60 may be substantially completely enclosed, in particular by means of a cover 70, especially a cover formed by the release liner 80, the substance dispenser 1 does not need to be packed by an additional airtight cover in order to substantially screen off the substance 60 from the atmosphere in the storage state of the substance dispenser 1. For example, it may be just packed in a box which is not substantially airtight, such as for instance a cardboard box. Such box, in particular a substantially rectangular and/or cuboid box may be stored relatively conveniently, for instance in a larger box or other container comprising multiple boxes that each may contain for instance a single substance dispenser 1.

Moreover, it is noted that since the substance 60 can thus be substantially completely enclosed in the storage state of the substance dispenser 1, it may be counteracted that the substance dries out. Additionally or alternatively, the enclosure of the substance 60, in particular an air-tight enclosure thereof, may counteract that fragrance to be released in the flush bowl 100 may evaporate prematurely. This may facilitate that the substance dispenser 1 can be perishable and/or may counteract that perfumes or smells can contaminate other provisions stored in the same place as said dispenser 1. Additionally or alternatively, the enclosure of the substance 60, in particular an air-tight enclosure thereof, may counteract that substance 60 can accidently leak out of a stored dispenser 1, for instance when the substance is accidently heated to such extent that the substance 60 melts, for instance when present in a car parked in full sun.

A substance dispenser 1 according to the present invention may be manufactured in any suitable manner. However, it may advantageously be manufactured by a method comprising the steps of: providing a substance holder 50, in particular a relatively flat substance holder; providing the substance holder 50 with a substance 60, in particular a pliable and/or paste-like substance 60, which preferably may comprise a cleaning agent, disinfectant, air freshener, and/or a descaling agent; and attaching, preferably adhering, a cover 70, in particular a cover 70 formed by a release liner

80, to the substance holder 50 and/or the substance 60 held therein, such as to cover the substance 60 at the top side of the substance holder 50.

Preferably, at the bottom side of the substance holder 50, the substance held in said substance holder 50 is covered by a bottom portion 51 of the holder 50 and/or by another part 20, 23 of the substance dispenser 1, such as an attachment zone 23 defined by a layer of film material 20, in particular a layer of film material 20 which includes a flexible connecting part 21 for temporary connecting said connecting part 21 to a rim 101 of the flush bowl 100.

During the manufacturing, a layer of film material 20 may be provided. A first portion thereof may be provided with the first adhesive 31, for removably connecting the dispenser 1 to a rim 101 of a flush bowl 100, and a second portion of said layer of film material 20, which may define the attachment zone 23, may be provided with the second adhesive 32 for adhering said attachment zone 23 to the substance 60, preferably in substantially permanent manner. Further, one or more portions, for instance defining the peel-off zone 22*a* or an intermediate part 24, may be kept free of adhesive. The film material 20 may optionally be provided with a print at any suitable moment. For example after a portion of the release liner 80 covering the attachments zone 23 is removed, in case it was present there in the first place, the attachments zone 23 may be adhered to the holder 50, for instance after a cup-shaped part of the holder is filled with substance 60. However, the holder 50 may alternatively be provided with substance after it is attached to the attachment zone 23, which for instance may be advantageous in case the holder is formed as mesh, sponge or textile structure or the like.

Further, in particular subsequently, an opposite side 50*b* of the holder 50 may be adhered to the release liner 80, in particular to a rear surface 80*b* thereof. Thereto, said rear surface may for instance be provided with a pre-applied adhesive, which for instance may have been temporarily covered by a second release liner (not shown) covering such pre-applied second adhesive 53 temporarily, e.g. before the holder 50 is adhered to the main release liner 80 which, contrary to such optional second release liner, can still be present in the storage state of the substance dispenser 1.

For instance in order to make the substance dispenser 1 relatively compact in its storage state, a portion of the layer of film material 20 and/or the release liner 80 on which it is carried, which portion extends beyond the portion adhered to the top side 50*b* of the holder 50, may be fold and/or bent over, for instance in a manner as is shown in FIG. 2.

Subsequently, the substance dispenser 1 may be packed in a packaging, such as a small cardboard box, which may be dimensioned to relatively snugly fit around said substance dispenser 1 in its storage state.

It is noted that the Figures are merely schematically representations of embodiments. The thickness of different layers and other parts are for instance not to scale, and it will be appreciated that the layer of plastic film material 20 may for instance be thinner than the release liner 80, while said release liner 80 may in turn may be thinner than the walls of the thermoformed container forming the substance holder 50, whereas that is not derivable from the schematic drawings.

Further it is noted that for the purpose of clarity and a concise description features are described herein as part of the same or separate embodiments, however, it will be appreciated that the scope of the invention may include embodiments having combinations of all or some of the features described.

Further, it is noted that the invention is not restricted to the embodiments described herein. It will be understood that many variants are possible.

For example, the adhesive may be in the form a glue applied directly to the layer of film material, but may alternatively be formed in a different manner, and may for instance be provided in the form of a double-side adhesive tape.

Such variants will be apparent for the person skilled in the art and are considered to lie within the scope of the invention as formulated in the following claims.

The invention claimed is:

1. A substance dispenser for temporarily placement on a flush bowl, comprising:

a flexible connecting part including a layer of film material defining a first surface which is provided with a first adhesive for temporary connecting said connecting part to a rim of the flush bowl;

a handle part, connected to the connecting part at or near a first end region of said connecting part, for handling the substance dispenser during placement on the flush bowl and for handling the substance dispenser during removal from the flush bowl;

a substance holder holding a substance, which may comprise a cleaning agent, disinfectant, air freshener, and/or a descaling agent, said substance holder being connected to the connecting part at or near a second end region of said connecting part;

wherein the substance holder, which holds the substance, includes one or more chambers for holding the substance, said one or more chambers at least being defined by a bottom and one or more sidewalls;

wherein the sidewall of the holder comprises a first flange being provided at an upper end of the sidewall and extending substantially sidewardly in a substantially outward direction, wherein the sidewall of the holder comprises a support element which extends from the first flange in a substantially downward direction, and wherein the holder comprises a second flange being provided at a lower end of the sidewall and extending sidewardly in an outward direction in line with or at a level below the bottom of said substance holder; and wherein the second flange is connected to the connecting part such that said substance holder is connected to the connecting part at or near a second end region of said connecting part.

2. The substance dispenser according to claim 1, wherein the layer of film material included in the flexible connecting part further defines an attachment zone which is attached to the substance holder.

3. The substance dispenser according to claim 1, wherein the substance holder and the substance held therein form a relatively flat structure, in particular a structure of which both its height and its width exceed its largest thickness.

4. The substance dispenser according to claim 1, wherein a first surface of the substance holder is a front face which is substantially closed off.

5. The substance dispenser according to claim 4, wherein the substance holder itself closes off the substance holder at its first surface.

6. The substance dispenser according to claim 4, wherein the layer of film material covers at least 80% of said first surface of the substance holder.

7. The substance dispenser according to claim 1, wherein, at least in a use state of the substance dispenser, one or more portions of a second surface of the substance holder are at least partly open such as to allow flushing water to contact the substance held by the substance holder.

8. The substance dispenser according to claim 7, wherein said substance dispenser is arranged such as to be brought from a storage state into the use state, and wherein, in said storage state of the substance dispenser, a cover substantially covers said one or more portions of the second surface which are at least partly open in the use state, and wherein said cover substantially covers said entire second surface of the substance holder in the storage state of the substance dispenser.

9. The substance dispenser according to claim 8, wherein the cover is formed at least partly by a release liner onto which, in the storage state of the substance dispenser, at least the flexible connecting part is at least partly carried, wherein the release liner defines a first surface onto which the at least part of the flexible connecting part is carried, wherein a portion of the first surface of the layer of film material defining said flexible connecting part is carried on said first surface of the release liner, and wherein the layer of film material further defines an intermediate part, interconnecting the attachment zone and the flexible connecting part, which, in the storage state of the substance dispenser, is bent, such as to allow that the attachment zone can, in said storage state, to extend substantially offset from an/or substantially parallel with the connecting part, in manner in which said attachment zone and said connecting part overlap at least partly.

10. The substance dispenser according to claim 8, wherein the substance dispenser is packed in a box which is not substantially airtight, and wherein the substance dispenser is free of any substantially airtight packing enveloping the substance dispenser within the box.

11. The substance dispenser according to claim 1, wherein the layer of film material included in the flexible connecting part defines the attachment zone which is attached to the substance holder and further defines the handle part.

12. The substance dispenser according to claim 11, wherein the handle part is left free of an outwardly facing adhesive layer, such as to allow a user to grab the handle part substantially without touching any sticky adhesive.

13. The substance dispenser according to claim 1, wherein a surface of the bottom facing away from the substance held by said holder is adhered to an attachment zone defined by the layer of film material.

14. The substance dispenser according to claim 1, wherein a surface of the substance holder facing towards and/or in contact with the substance, is provided with a substantially raster-shaped relief structure, wherein said relief structure has a height of at most 10 mm.

15. The substance dispenser according to claim 1, wherein the substance holder is substantially formed as a plate.

16. The substance dispenser according to claim 1, wherein the substance is a pliable substance and/or paste which adheres to the substance holder.

17. A flush bowl of a flush toilet, provided with a substance dispenser according to claim 1.

18. A method for manufacturing a substance dispenser according to claim 1, said method comprising the steps of:

providing a a relatively flat substance holder;

providing the substance holder with a pliable and/or paste-like substance, which may comprise a cleaning agent, disinfectant, air freshener, and/or a descaling agent; and covering with a cover formed by a release liner, to the substance holder and/or the substance held therein, such as to cover the substance at the top side of the substance holder, wherein, at the bottom side of the substance holder, the substance held in said substance holder is covered by a bottom portion of the holder and/or by another part of the substance dispenser, such as an attachment zone defined by a layer of film material, in particular a layer of film material which includes a flexible connecting part for temporary connecting said connecting part to a rim of the flush bowl.

* * * * *